United States Patent [19]

Kellner

[11] 4,071,285

[45] Jan. 31, 1978

[54] STABILIZER

[75] Inventor: Jackson M. Kellner, Midland, Tex.

[73] Assignee: Smith International, Inc., Midland, Tex.

[21] Appl. No.: 720,695

[22] Filed: Sept. 7, 1976

[51] Int. Cl.[2] ..... F16C 17/00

[52] U.S. Cl. ..... 308/4 A; 175/325; 308/8.2

[58] Field of Search ..... 308/4 R, 4 A, 8.2; 175/107, 325, 343, 347, 323, 346

[56] References Cited

U.S. PATENT DOCUMENTS

| | | | |
|---|---|---|---|
| 1,776,611 | 5/1950 | Akeyson | 175/406 X |
| 3,400,773 | 9/1968 | Tiraspolsky et al. | 175/325 X |
| 3,413,045 | 11/1968 | Wohlfeld | 308/4 A |
| 3,463,270 | 8/1969 | Lundstrom et al. | 308/8.2 |
| 3,754,609 | 8/1973 | Garrett | 175/325 X |
| 3,982,594 | 9/1976 | Berthiaume | 175/325 X |

*Primary Examiner*—Joseph F. Peters, Jr.
*Assistant Examiner*—Gene A. Church
*Attorney, Agent, or Firm*—Murray Robinson; Ned L. Conley; David Allen Rose

[57] ABSTRACT

The eccentric journals of a tandem roller stabilizer are azimuthally positioned relative to each other by the heads of end plate assembly bolts of each roller assembly extending into sockets in the end plates of the adjacent roller assembly.

10 Claims, 3 Drawing Figures

STABILIZER

BACKGROUND OF THE INVENTION

This invention relates to earth boring apparatus and more particularly to roller stabilizers useful in the rotary system of boring blast holes.

Difficulty has been experienced with stabilizers the type employing plural colevel rollers mounted on parallel off-axial journals when the hole size is increased, e.g., up to 15 or more inches in diameter. Larger bearing diameters are needed to accommodate the large lateral loads without undue wear. A similar problem arises with roller reamers, which are similar to roller stabilizers, the latter being undergage while rollers are full-gage. A solution to the problem is the employment of tandem rollers mounted on eccentric journals extending around the stabilizer mandrel. Such construction is already known, e.g., for roller reamers, as shown in U.S. Pat. No. 3400773 to TIRAPOLSKY et al. See also U.S. Pat. No. 1772491 to Koppl, and U.S. Pat. No. 1,776,611 to Akeyson.

With tandem rollers it is necessary to orient the eccentric journals azimuthally relative to each other in order to distribute the lateral loading uniformly about the axis of the reamer mandrel. Otherwise the rollers would cause the mandrel to deflect and reduce the effectiveness of the reamer. In this regard Tirapolsky, referring to the elements on which the rollers rotate as hubs, states:

"A suitable assembly can be obtained by connecting the hubs of the consecutive reaming elements by coupling rings in which the hubs are screwed but it is very difficult in this way to obtain a correct relative angular positioning of the axes of the hubs around the axis of the body of the remaining tool.

Another solution is the use of a shaft for the reaming tool on which eccentric hubs are mounted and the rollers turn on these hubs on axes parallel to the shaft with the hubs being fastened to the shaft for rotation either by keying on the shaft or by utilization of a shaft having a polygonal section.

Any of the solutions discussed above require a shaft having a cross-section sufficient to transmit large forces of rotation to the reaming elements.

An object of the present invention is to provide a rigid assembly of reaming elements in which the transmission of the torque to these reaming elements is provided by the assembly itself which is solidly and directly connected to the driving shaft of the bottom motor which drives the tool in rotation."

Tirapolsky employs rings between his hubs, the rings having eccentric sockets to receive and position the hubs, which are largely out of contact with the mandrel.

Koppl employs a polygonal section shaft and Akeyson employs hubs keyed to the shaft, as mentioned by Tirapolsky.

SUMMARY OF THE INVENTION

According to the invention the several eccentric journals of a tandem roller stabilizer are oriented relative to each other by means of pins in each roller assembly being received in sockets in adjacent roller assemblies. More specifically, such pins are provided by the protruding heads of bolts used to secure some of the end plates to journals on which the rollers turn. The sockets are provided by the mouths of bores in the adjacent end plates of adjacent roller assemblies which bores receive the countersunk heads of such assembly bolts.

BRIEF DESCRIPTION OF THE DRAWINGS

For a more detailed description of a preferred embodiment of the invention reference will now be made to the accompanying drawings wherein.

DESCRIPTION OF PREFERRED EMBODIMENT

Stabilizer Assembly

Figure 1:
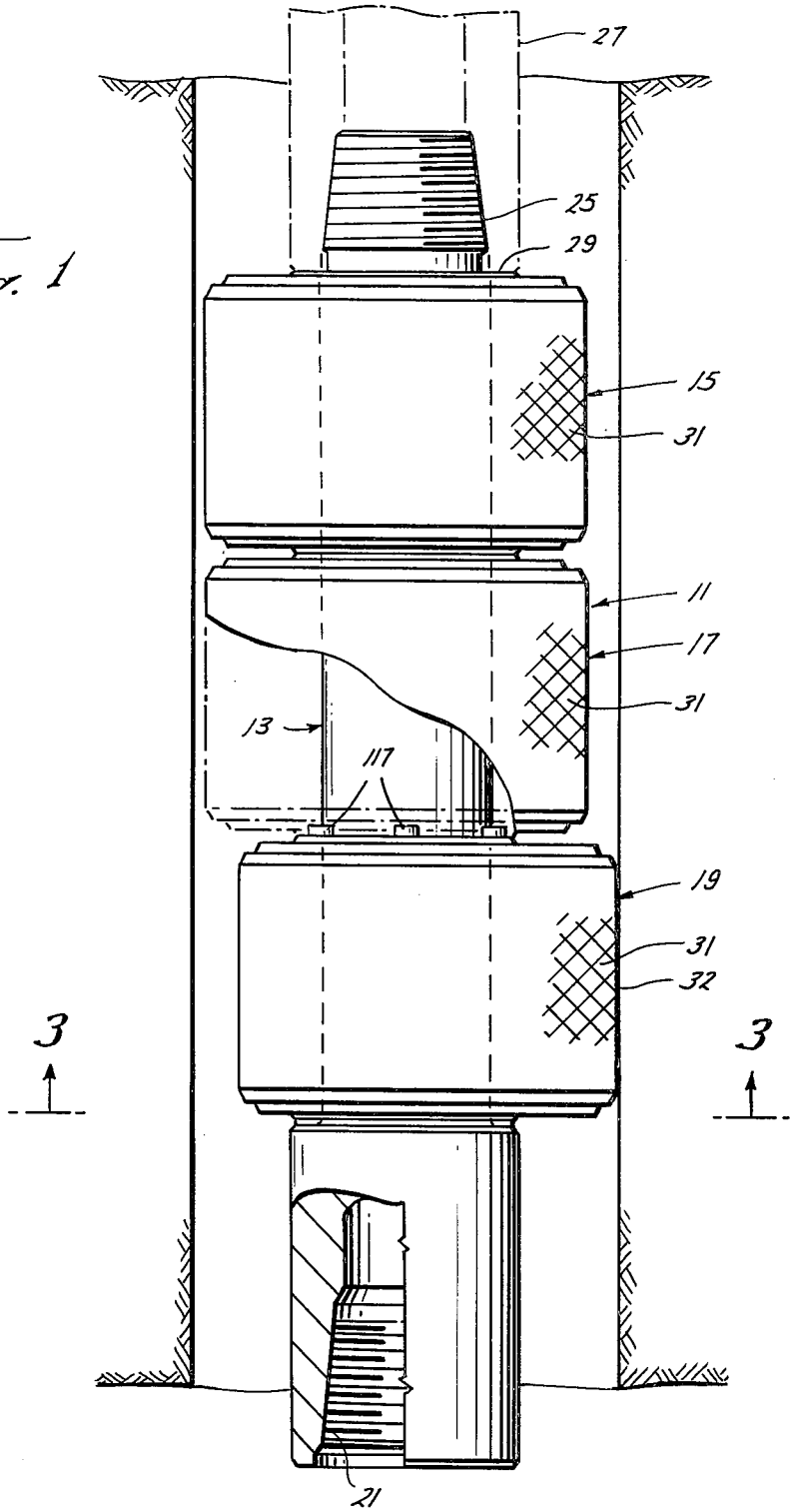
FIG. 1 is a side elevation of a stabilizer embodying the invention, one of the roller assemblies being partially broken away to expose the mandrel.

Referring now to FIG. 1 there is shown a stabilizer comprising a tubular body 11 including mandrel portion 13, the outer periphery of which is adapted to receive the roller assemblies 15, 17, 19. Adjacent one end of the mandrel the body is provided with an internally taper threaded box 21 for making a rotary shouldered connection with an adjacent drill string member, e.g. a bit. For a more detailed disclosure of rotary shouldered connections see U.S. Pat. No. 3754609 to Garrett.

A shoulder 23 is formed at the juncture of the box 21 and the mandrel 13, providing stop means at one end of the mandrel limiting axial motion of the roller assemblies relative to the mandrel in the direction toward the box. At the other end of the mandrel the body 11 is provided with an externally taper threaded pin 25 for making a rotary shouldered connection with another drill string member, e.g. a tool joint box 27 on the lower end of a drill collar or a sub. The shoulder 29 provided by the mouth of the box 27 provides stop means to prevent axial motion of the roller assemblies relative to the mandrel in the direction toward pin 25. When the box 27 is made up tight on pin 25 the roller assemblies are axially compressed against shoulder 23 and transmit torque between the shoulder 29 and shoulder 23 in the manner described in the aforementioned Garrett patent, and to some degree in the manner described in the aforementioned Tirapolsky et al patent.

The outer peripheries of the roller assemblies are provided with suitable wear reducing means such as inserted tungsten carbide buttons, as is disclosed in the 1974–75 edition of the Composite Catalog of Oilfield and Pipeline Services at page 1774 and in U.S. Pat. Nos. 3667817 (Kellner), 3285678 (Garrett & Crews), and 3306381 (Garrett & Moore). Generalized wear reducing means is indicated at 31 on each of the roller assemblies. Such means 31 on roller assembly 19 is shown to be in contact with the wall 32 of the bore hole. The wall contacting portions of the other roller assemblies are displaced azimuthally from that of the adjacent roller assemblies by an angle X equal to 360° divided by the number of roller assemblies. With three roller assemblies the wall contacting portions are spaced apart 120°. Orienting means for effecting this result will be described later on hereinafter. Any desired number of roller assemblies can be used, for example two through six or more roller assemblies.

ROLLER ASSEMBLY

Figure 2:
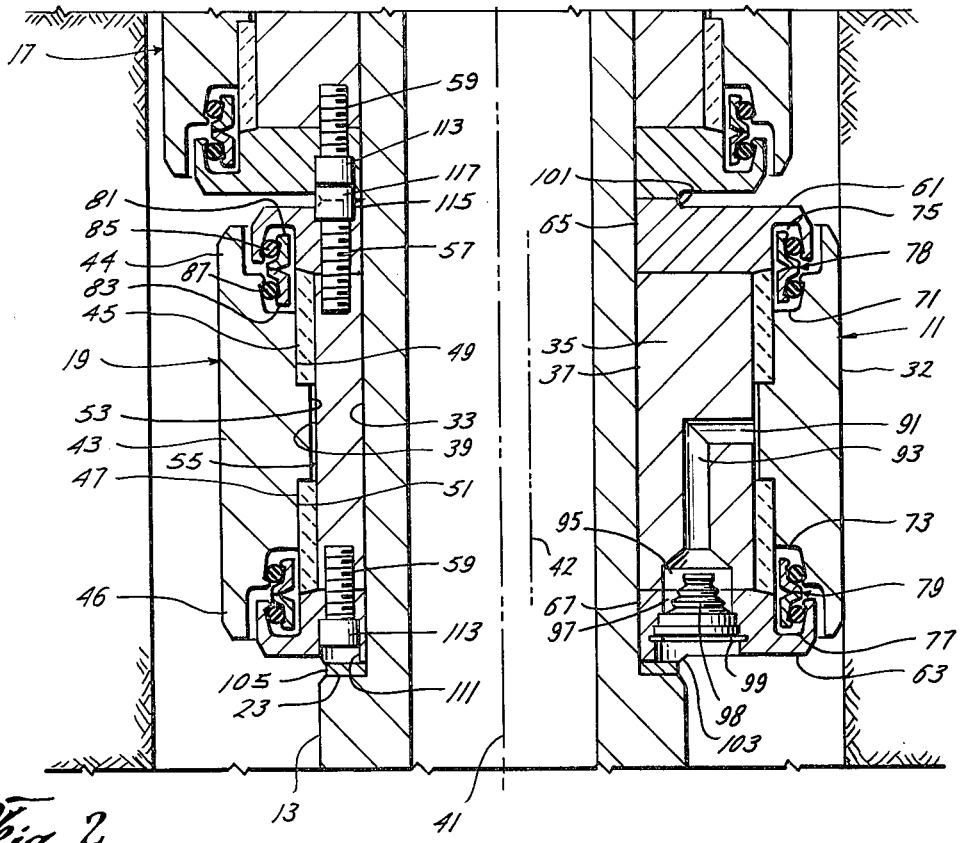
FIG. 2 is an axial section through one of the roller assemblies and associated portions of the mandrel on which it is mounted.

Referring now to FIG. 2, the mandrel 13 has a smooth cylindrical outer periphery 33 about which are disposed the three roller assemblies 15, 17, 19. Each roller assembly, e.g. 19, includes a journel 35 having a smooth cylindrical bore 37 received on the outer periphery of the mandrel.

The outer periphery 39 of the journal is a smooth cylindrical surface eccentric to the bore 37 of the journal and the axis 41 of the mandrel. The journel axis is indicated at 42.

Rotatably mounted on journal 35 is generally cylindrical annular roller 43. The roller 43 is of about the same axial extent as journal 35 except for cylindrical cuffs 44, 46 at the upper and lower ends of the roller. Wear reducing means 31 on the outer periphery of the roller is concentric with journal axis 42.

Bushings 45, 47 of bronze or other suitable bearing material are received within cylindrical bores 49, 51 in the ends of the roller. Bushings 45, 47 provide radial bearing means for the rollers cooperating with journal 35 eccentrically rotatably mounting the roller on the stabilizer body.

Bushings 45, 47 may be press fitted or soldered in place within roller 43. The inner diameters of the bushings are smaller than the inner diameter of the mid-portion 53 of the inner periphery of roller 43. This leaves an annular space 55 between the roller and the journal which is filled with lubricating and cooling liquid such as oil.

Secured to the upper and lower ends of journal 35 by rings of cap screws or bolts 57, 59 (see also FIG. 3) are end plates 61, 63. The end plates are eccentrically apertured at 65, 67 to fit snugly around the mandrel. The outer peripheries of the end plates are of larger diameter than the journal, extending out over the inner portions of the ends of the roller to just inside cuffs 44, 46. The plates overlap the ends of the bushings 45, 47 and prevent axial motion of the roller 43 relative to the journal 35. The plates and bushings thus form thrust bearings.

The inner portions of the ends of the roller are provided with annular pockets 71, 73. The seal plates are provided with annular pockets 75, 77 registering with pockets 71, 73. Disposed within the upper pair of pockets 71, 75 is a suitable rotating seal means 77. A similar rotating seal means 79 is disposed in the lower pair of pockets 73, 77. Preferably, as shown, each such seal means is a seal made by the Caterpillar Tractor Company known in the art as a Caterpillar seal. Such a seal comprises a pair of flat faced metal bearing rings 81, 83 urged into contact by a pair of elastomeric toruses or O-rings 85, 87. The outer walls of the pockets in the end plates and the outer peripheries of the bearing rings are tapered so that the O-rings exert axial pressure on the bearing rings to cause a seal therebetween. One bearing ring of each seal means remains stationary relative to the adjacent end plate and the other bearing ring turns with the adjacent roller.

The clearance space between the end plates, roller, and journal, including space 55, sealed off by the seal means 77, 79, provides a reservoir for the lubricating and cooling liquid or oil. Radial and axial ports 91, 93 in the thickest part of the journal connect space 55 with fill opening 95 in the lower end of the roller. In register with fill opening 95 is fill port 97 in the lower end plate 63 which is closed by means of a suitable volume compensator such as a flexible diaphragm 98 releasably held in place by a split resilient ring 99. The volume compensator allows the oil in the reservoir to expand when heated, thereby preventing oil loss through the seal means 77, 79. For a further discussion of volume compensation for drilling tool lubricant reservoirs see U.S. Pat. Nos.

| | |
|---|---|
| 3,413,045 | - Wohlfeld |
| 3,463,270 | - Lundstrom (cf.). |

The end plates 61, 63 are provided with annular bosses 101, 103. These bosses engage like bosses on the end plates of adjacent roller assemblies, except the lowermost boss engages a washer 105 adjacent shoulder 23 on the stabilizer body and the uppermost boss engages the shoulder 29 formed by the lower end of the tool joint box 27. It is through these bosses that most of the torque is transmitted to and through the roller assemblies from shoulder 23 to shoulder 29 when the stabilizer is in use, only a small fraction of the torque being transmitted through the threads of box 25 to the reamer body.

ROLLER ASSEMBLY ORIENTATION

Still referring to FIG. 2, the lower end plate 63 of each roller assembly is provided with deep countersink bores 111 which have depths greater than the lengths of the heads 113 of the bolts or cap screws 59 received therein. When the bolts are in place the mouths of bores 111 are still open, providing sockets. The upper end plates of the lower and middle roller assemblies have only shallow countersink bores 115. Bores 115 have depths less than the height of the heads 117 of the bolts or cap screws 57 received therein. When bolts 57 are in place, their heads protrude from the end plates providing alignment pins adapted to be received in the sockets provided by the mouths 111 of the deep countersink bores in the adjacent end plates. The upper end plate of the uppermost roller assembly is provided with countersink bores deep enough to fully receive the heads of the bolts that hold the end plate to the journal. Other strategems can be employed to accommodate the bolt heads of the upper plate of the uppermost roller assembly.

Figure 3:
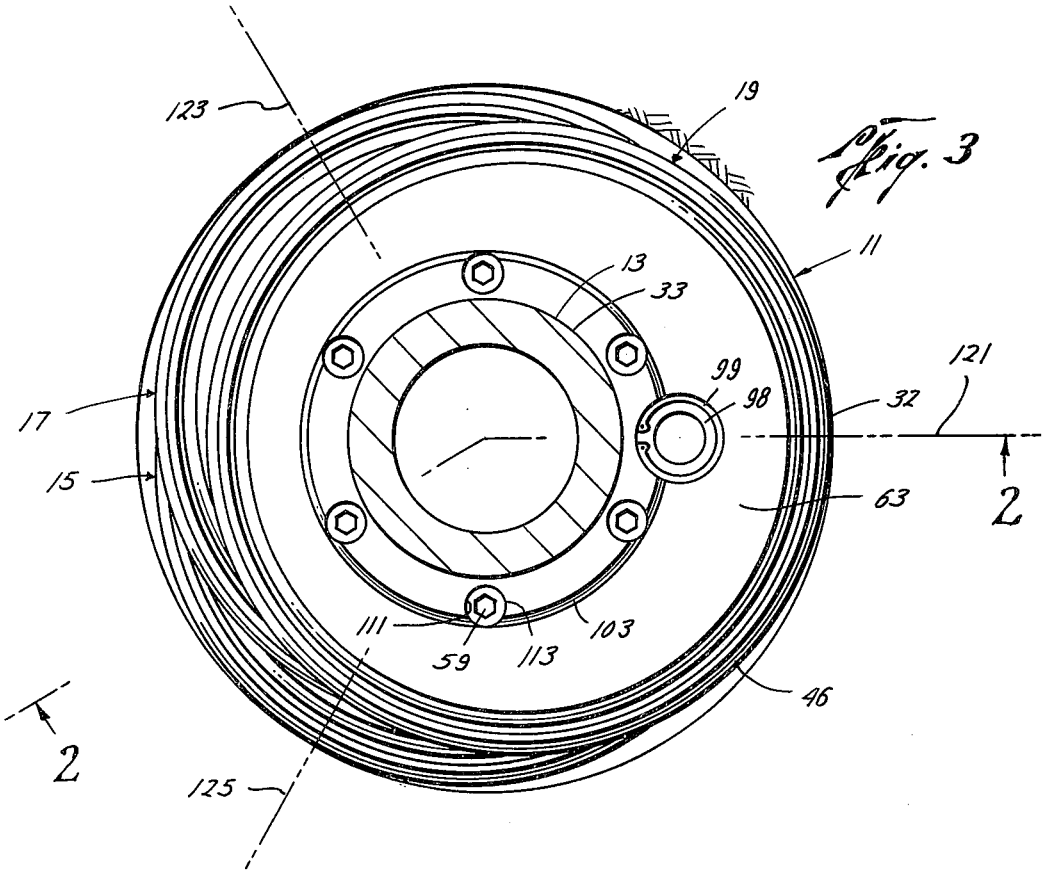
FIG. 3 is a transverse section taken on a plane indicated at 3—3 on FIG. 1 and showing a bottom end view of the roller assembly shown in FIG. 2.

Referring now to FIG. 3, each of the circles of bolts 59 include six bolts spaced sixty degrees apart, i.e. at the corners of a regular hexagon. Therefore with the roller assemblies all constructed alike, the assemblies can be stacked with their common eccentric diameters displaced 120°, as shown in FIG. 3 at 121, 123, 125. By common eccentric diameter is meant the diameter joining the center of the journals inner periphery and the center of the journal's outer periphery.

If a different number of rollers than three is to be used, the angular spacing X of the common eccentric diameters of the several journals will be 360° divided by $n$ where $n$ Is the number of rollers. The angular separation Z of the end plate bolts should be evenly divisible into X. In other words X/Z is an integer.

When the earth formation reducing means or the bearings or other part of the rollers wears out the roller assemblies can be easily removed for replacement by unscrewing the box 27 and pushing the roller assemblies off the mandrel, for the journals are axially slidable on the mandrel. Substitute roller assemblies can then be slipped on the mandrel and oriented by means of the above-described pin and socket means. The box 27 is then screwed back on and tightened and the reamer is then screwed back on and tightened and the stabilizer is renewed.

Although the subject invention is intended for use as a stabilizer, e.g. for blast hole drilling, it is of more general utility, and its principles may also be employed for reamers. For this reason the invention may be referred to in the claims as a Wall Contacting Tool.

While a preferred embodiment of the invention has been shown and described modifications thereof can be made by one skilled in the art without departing from the spirit of the invention:

I claim:

1. Wall contacting tool comprising a mandrel having a plurality of eccentric roller assemblies disposed in tandem along the length of the mandrel, each of the assemblies being provided with orientation means independent of the mandrel to prevent the assemblies from being positioned in full axial engagement except when in any one of a predetermined limited number of fixed relative azimuthal orientations of the common eccentric diameters.

2. Wall contacting tool according to claim 1 in which the orientation means comprises a pin and a socket on each adjacent pair of roller assemblies.

3. Wall contacting tool according to claim 2 in which each roller assembly includes a journal and end plates bolted to the journal, the pin being provided by a protruding bolt head and the socket being provided by a countersink bore deeper than one of the bolt heads.

4. Wall contacting tool according to claim 3 in which each end plate is secured to the journal by a circle of bolts and all of the bolt heads in one circle are received in all of the countersink bores for the circle of bolts in the adjacent end plate to orient each adjacent pair of roller assemblies.

5. Wall contacting tool according to claim 4 in which the number of roller assemblies is *n*, the common eccentric diameters of the roller assemblies are azimuthally spaced by an angle $X = 360/n°$, and the bolts in each bolt circle are equally spaced by an angle Z where x/z is an integer.

6. Wall contacting tool comprising a tubular body including a mandrel having at one end a threaded pin adapted to receive a releasable box and having a threaded box at the other end forming a shoulder with the mandrel, and a plurality of roller assemblies releaseably mounted on said mandrel, being axially slidable relative to the mandrel when said releasable box is removed, said mandrel having a smooth 360° cylindrical outer periphery, each roller assembly comprising:

a journal in the form of a sleeve having a smooth 360° cylindrical inner periphery adapted to fit slidably on said mandrel and having an outer periphery eccentric to said inner periphery, a roller rotatably mounted on the journal, and end plates secured by bolts to each end of the journal retaining the roller against axial displacement relative to the journal, the adjacent end plates of each adjacent pair of rollers being azimuthally oriented by the heads of the bolts in one plate entering countersink bores for the heads of the bolts in the adjacent end plate.

7. Wall contacting tool according to claim 6 in which each end plate is provided with an annular boss on the outer face, said bosses of adjacent plates being in torque transmitting frictional engagement when said roller assemblies are stacked on said mandrel against said shoulder and said releasable box is made up tight on the mandrel pin.

8. Wall contacting tool according to claim 7 in which the bolt circles are in said bosses, and including a washer between the mandrel shoulder and the boss on the adjacent end plate, and means to accommodate the bolt heads of the end plate adjacent said releaseable box.

9. Wall contacting tool according to claim 8, each roller assembly further including:

annular seal means between each end plate and the roller, bearing bushings fixed in counterbores in the ends of the roller, engaging the journal to take radial loads and engaging the end plates to take axial loads, port means for filling with oil the reservoir provided by the clearances between the journal, bushings, end plates and roller, and volume compensating means in said port means to accommodate increased oil volume due to heating of oil in the reservoir, said volume compensating means of each roller assembly being located in the thickest part of the journal and partially overlapping the adjacent boss on the end plate, being disposed between bolts in the bolt circle.

10. Wall contacting tool according to claim 1 in which the orientation means is independent of the mandrel.

* * * * *

UNITED STATES PATENT OFFICE

CERTIFICATE OF CORRECTION

Patent No. 4,071,285 Dated January 31, 1978

Inventor(s) Stabilizer

It is certified that error appears in the above-identified patent and that said Letters Patent are hereby corrected as shown below:

Column 3, line 6, change "journel" to --journal--.
Column 3, line 11, change "journel" to --journal--.
Column 4, line 52, change "journals" to --journal's--.
Column 4, line 57, change "Is" to --is--.
Column 5, line 47, change "releaseably" to --releasably--.
Column 6, line 26, change "releaseable" to --releasable--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*